US006629370B1

(12) United States Patent
Sposato

(10) Patent No.: US 6,629,370 B1
(45) Date of Patent: Oct. 7, 2003

(54) BOARD CUTTER

(75) Inventor: Patrick J. Sposato, 1059 Oakwood Trail, Luzerne, MI (US) 48636

(73) Assignee: Patrick J. Sposato, Luzerne, MI (US)

( * ) Notice: Subject to any disclaimer, the term of this patent is extended or adjusted under 35 U.S.C. 154(b) by 0 days.

(21) Appl. No.: 09/436,284

(22) Filed: Nov. 8, 1999

(51) Int. Cl.[7] ..... B26B 29/06

(52) U.S. Cl. ..... 33/42; 33/485; 33/32.2; 30/29; 30/3

(58) Field of Search ..... 33/42, 484, 485, 33/474, 479; 30/293

(56) References Cited

U.S. PATENT DOCUMENTS

| | | | | | |
|---|---|---|---|---|---|
| 1,877,185 | A | * | 9/1932 | Lowe | 33/42 |
| 1,915,636 | A | | 6/1933 | Wendelken | 30/122 |
| 2,200,975 | A | * | 5/1940 | Anderson | 33/32.3 |
| 2,818,644 | A | | 1/1958 | Crawford | 30/293 |
| 3,286,351 | A | | 11/1966 | McAlister | 33/42 |
| 3,343,266 | A | * | 9/1967 | Dolgorukov | 33/479 |
| 4,903,409 | A | | 2/1990 | Kaplan et al. | 30/293 |
| 4,949,462 | A | | 8/1990 | Spencer | 30/293 |
| 4,979,304 | A | | 12/1990 | Sprague | 30/293 |
| 5,048,189 | A | | 9/1991 | Aurness et al. | 30/293 |
| 5,083,375 | A | | 1/1992 | Helm, Sr. | 30/294 |
| 5,231,764 | A | | 8/1993 | Chang | |
| 5,265,342 | A | | 11/1993 | Lang, Jr. | 30/294 |
| 5,459,937 | A | * | 10/1995 | Albin et al. | 33/479 |
| 5,471,753 | A | | 12/1995 | Rodrigues | 33/42 |
| 5,600,892 | A | | 2/1997 | Peugh et al. | 30/292 |
| 5,732,472 | A | | 3/1998 | Praye | 33/42 |
| 5,996,237 | A | * | 12/1999 | Sanders | 33/42 |
| 6,070,331 | A | * | 6/2000 | Dempsey | 33/42 |
| 6,467,174 | B1 | * | 10/2002 | Kotori | 30/293 |

* cited by examiner

*Primary Examiner*—David Martin
*Assistant Examiner*—Jeanne-Marguerite Goodwin
(74) *Attorney, Agent, or Firm*—Reising, Ethington, Barnes, Kisselle & Learman, P.C.

(57) ABSTRACT

The board cutter includes a T-square and a knife. The T-square has a head with a board edge contact surface and a board face contact surface. A long leg of the T-square is attached to the head. A board face contact surface on the bottom of the long leg slides along a board face during use. A slider is slideable along a slot in the long leg and is clamped in any position along the slot. The knife is pivotally connected to the slider for pivotal movement about an axis that is parallel to the slot in the long leg. Penetration of the cutter into a board is controlled manually as the T-square is slid along surfaces of the board.

9 Claims, 3 Drawing Sheets

BOARD CUTTER

TECHNICAL FIELD

The invention relates to a board cutter for cutting gypsum board and foam insulation board and more particularly to a combination T-square guide and mat knife for accurately cutting large boards.

BACKGROUND OF THE INVENTION

Builders employ gypsum board for interior walls and ceilings and foam insulation board for insulation coverings of various surfaces in home and commercial building construction. These boards are generally about four feet wide and eight, twelve or sixteen feet long. The dimensions vary somewhat if the sheets are metric. The boards are cut for attachment to wall studs and other structural beams.

The cuts in gypsum board and foam insulation board must be fairly accurate to fit on the studs and to provide good joints between boards. The cuts must also be made quickly to reduce building costs. Both gypsum board and foam insulation boards are severed by making a shallow cut and then breaking the boards along a line where the boards are weakened by the shallow cut.

Cuts across the width of a board are made quickly and accurately using a T-square with a long leg that is up to four feet long and a mat knife. A four-foot T-square is easily transported without damage.

Making a straight cut that extends the length of gypsum and foam insulation boards is relatively difficult. Transportation of long beams with a straight edge is also difficult. Frequently long straight edge members are bent and destroyed. Long beams with a straight edge may require an additional person to hold the straight edge beam during cutting with a mat knife.

Long cuts have been made by construction workers using a T-square and a knifeblade. Numerous T-square and knife combinations have been tried over the years. These combination T-squares and knifeblades have drawbacks that result from having a knifeblade that is rigidly secured to the long leg of the T-square. The knifeblade tends to raise the long leg up off of the surface of the board that is being cut when hard material spots in the board are encountered. Up and down movement of the long leg of the T-square makes it somewhat more difficult to accurately guide the knifeblade and cut the board along a straight line occasionally construction workers like to make a second deeper cut when hard material is encountered in a board. To increase the depth of a knifeblade that is rigidly clamped to a T-square, it is necessary to loosen the blade, reset the position of the blade and then clamp the blade back to the blade holder. This procedure takes time. It can also be difficult to determine a depth setting of the blade.

Knifeblade penetration forces and cutting forces are transmitted between the knifeblade and the long leg of a T-square when the knifeblade is rigidly secured to the T-square. The T-square must be somewhat stronger and weigh more to withstand these extra forces. The transmission of force through the T-square to the knifeblade to obtain penetration and to cut material makes guidance of the blade by the T-square somewhat more difficult and less accurate.

SUMMARY OF THE INVENTION

The combination T-square and mat knife cutter for making straight cuts in long sheets of gypsum board and foam insulation boards includes a head with a board edge contact surface and a board face contact surface. A long leg is connected to the head. A bottom surface of the long leg is a board face contact surface that slides along the face surface of a board that is being cut. A slider is slideably mounted on an upper surface of the long leg. A clamp fixes the position of the slider in selected positions along the length of the long leg. A knife having a handle and a knifeblade is pivotally connected to a knife support on the slider for pivotal movement about a knife axis. The knife axis is parallel to a long axis of the long leg of the T-square and spaced from the board face contact surface.

The connection of the knife to the T-square for pivotal movement about a knife axis allows a construction worker and others to manually control the depth of cut and the pressure exerted on the knifeblade. The T-square guides the knifeblade only. A board face contact surface on the long leg can remain in sliding contact with a board that is being cut. Forces exerted on the T-square by the mat knife during cutting are minimized. Reducing the force exerted on the T-square permits a reduction in T-square weight and improves the accuracy of a cut in a board at the same time. If the construction worker wishes to make a second deeper cut in the same location, the T-square and mat knife are moved back to the starting position and another cut is made. No additional adjustment is required.

BRIEF DESCRIPTION OF THE DRAWINGS

The presently preferred embodiments of the invention are disclosed in the following description and in the accompanying drawings, wherein.

DESCRIPTION OF THE PREFERRED EMBODIMENT

Figure 1:
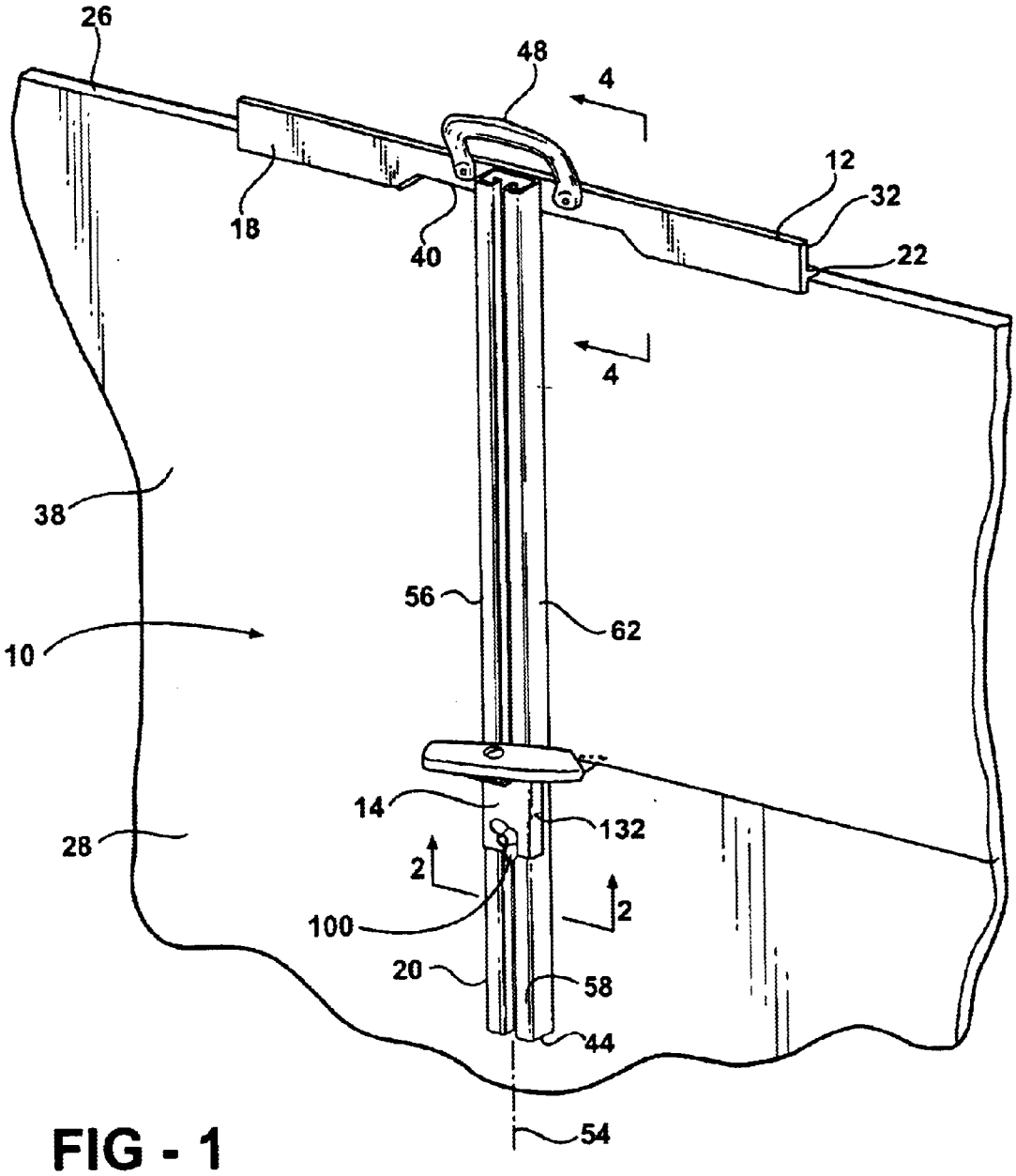
FIG. 1 is a perspective view of the T-square and knife cutter.

The board cutter generally designated by reference number 10 includes a T-square 12, a slider 14 and a mat knife 16. The T-square 12 has a head 18 and a long leg 20.

Figure 4:
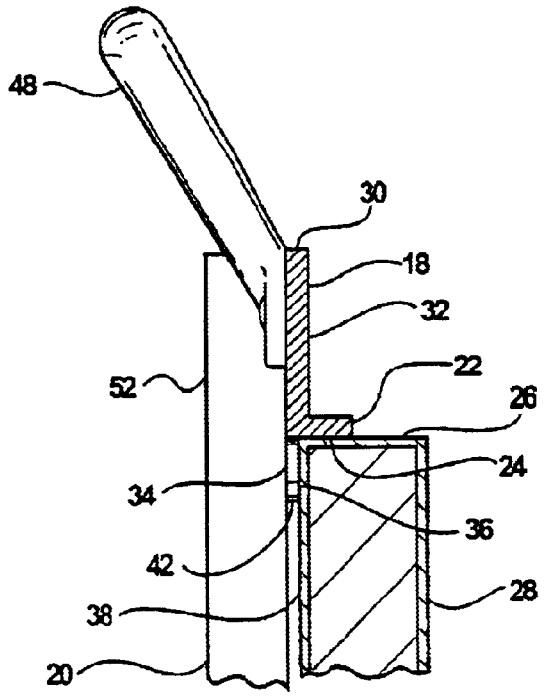
FIG. 4 is an enlarged section view taken along line 4—4 in FIG. 1.

The head 18 is a T-shaped extrusion as shown in FIG. 4. The trunk 22 is a short member with a board edge contact surface 24 that extends the length of the head 18. The board edge contact surface 24, as shown in FIGS. 1 and 4 is in contact with an edge 26 of a gypsum board or foam insulation board 28. A cross bar 30 is integral with the trunk 22 and is transverse to one end of the trunk. A long wing 32 of the cross bar 30 forms a hand grip for sliding the T-square 12 along the edge 26. A short wing 34 of the cross bar 30 has a board face contact surface 36 that is in contact with the face 38 of board 28. The board face contact surface 36 extends to both ends of the head 18. However, the center portion of the short wing 34 is removed to form a cutout 40 shown in FIG. 1. The knife blade cutout 40 makes it possible to move the mat knife 16 up to the board edge contact surface 24.

The long leg 20 of the T-square 12 is rigidly secured to the center of the head 18 and extends past a free edge 42 of the short wing 34. A free end 44 of the long leg 20 is preferably between 24 inches and 48 inches from the board edge contact surface 24. However, if the width of the boards 28 is not 48 inches, the length of the long leg 20 may require some adjustment. The long leg 20 should have a length that is at least half the width of boards 28 that are to be cut. Maximum length of the long leg 20, from the edge contact surface 24 to the free end 44 should not exceed the width of a board 28. If the long leg 20 is too long, a board 28 cannot be cut when the board is on a floor and leading against a wall.

A handle 48 may be attached to the head 18 as shown in FIGS. 1 and 4. The long wing 32 may serve as a handgrip as mentioned above. However, a person grasping the wing 32 may have inadequate finger space when cutting a board leaning against a wall or setting on a floor. The added handle 48 provides additional space for holding and sliding the T-square on the edge 26 of a board 28.

The long leg 20, as shown in the drawing, is a tubular member with a slot so extending through the upper wall 52. The slot 50 is parallel to a central axis 54 of the long leg 20. Top walls 56 and 58 extend outward from both sides of the slot 50. Side walls 60 and 62 extend at right angles to the top walls 56 and 58. A bottom wall 64 is integral with both side walls 60 and 62 and has a leg board face contact surface 66. The slot 50 is defined by side walls 68 and 70. Flanges 72 and 74 are integral with the side walls 68 and 70 on either side of the slot 50 and have clamp engaging surfaces 76 and 78.

The slider 14 has a channel-shaped base 80 with a web 82 and two side flanges 84 and 86. The web 82 contacts the top walls 56 and 58 of the long leg 20. Side flanges 84 and 86 of the base 80 contact the side walls 60 and 62. A bolt 88 has a shank 90 that is received in the slot 50 of the long leg 20 and a head 92 that engages the clamp engaging surfaces 76 and 78. The shank 90 also passes through an aperture 98 through the channel-shaped base 90. A wing nut or clamp 100 screws onto the bolt 88 and is tightened to fix the position of the slider 14 in any one of an infinite number of positions along the length of the long leg 20 and the slot 50. A carriage bolt 88 to keep the shank 90 from rotating in the slot 50. A carriage bolt can be used in place of the bolt 88 to keep the shank 90 from rotating in the slot 50. An upright flange 102 on one end of the channel-shaped member has three mat knives mounting apertures 104, 106 and 108.

The mat knife 16 has a handle 110 and a blade 112. A mounting aperture 114 passes through the handle 110. A pivot bolt 116 passes through the aperture 114. A nut 118 screws onto the bolt 116 to a position in which the handle is axially fixed on the bolt but free to rotate relative to the bolt. The bolt 116 is inserted through one of the knife mounting apertures 104, 106 or 108 and a wing nut 120 is screwed onto the pivot bolt 116 and tightened. In the described position, the axis of the pivot bolt 116 is parallel to the axis 54 of the long leg 20. The axis of the pivot bolt 116 is also spaced from the long leg 20 as shown in FIG. 2.

Figure 2:
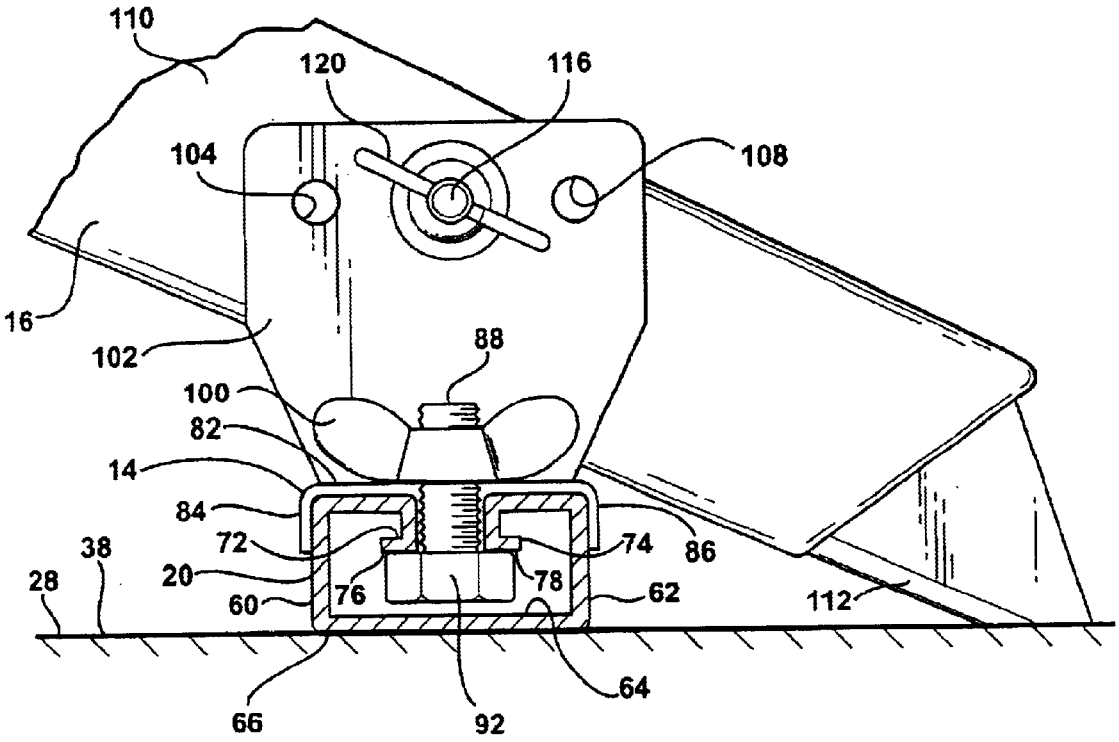
FIG. 2 is an enlarged sectional view taken along line 2—2 in FIG. 1.

The pivot bolt 116 is held in the center aperture 116 with a free end of the handle 110 of the mat knife 16 extending toward the aperture 104 as shown in FIGS. 1 and 2. This is the proper position for a right-handed person to cut gypsum board. The blade 112 does not penetrate very deep into a gypsum board due to the density of the gypsum. A relatively shallow cut through the paper cover on the board 28 and into the gypsum allows a board to be broken and divided into two pieces. Foam insulation board 28 is also cut partway through the board to score the board and then the board is broken. However the cut should be substantially deeper than the cut in gypsum boards. The blade 112 of the mat knife 16 is penetrating into the board 28 about as deep as it can as shown in FIG. 2. A slight increase in the depth of penetration, obtained by pivoting the mat knife 16 about the axis of the pivot bolt 116, will move the handle 110 into contact with the channel-shaped base 80. To obtain increased penetration of a foam insulation board 28, the pivot bolt 116 is moved from the center aperture 106 to the aperture 108.

A left handed person, using the board cutter 10 would reverse the mat knife 16 on the pivot bolt 116 and insert the pivot bolt back into the center aperture 106 to cut a relatively hard board such as gypsum board. For a left-handed person to cut foam insulation board 28, the pivot bolt 116 is moved to the aperture 104.

A relatively thin foam insulation board does not need to be cut any deeper than a gypsum board. When a requirement arises to sever a thin foam insulation board, the pivot bolt 116 can remain in the center aperture 106.

Figure 3:
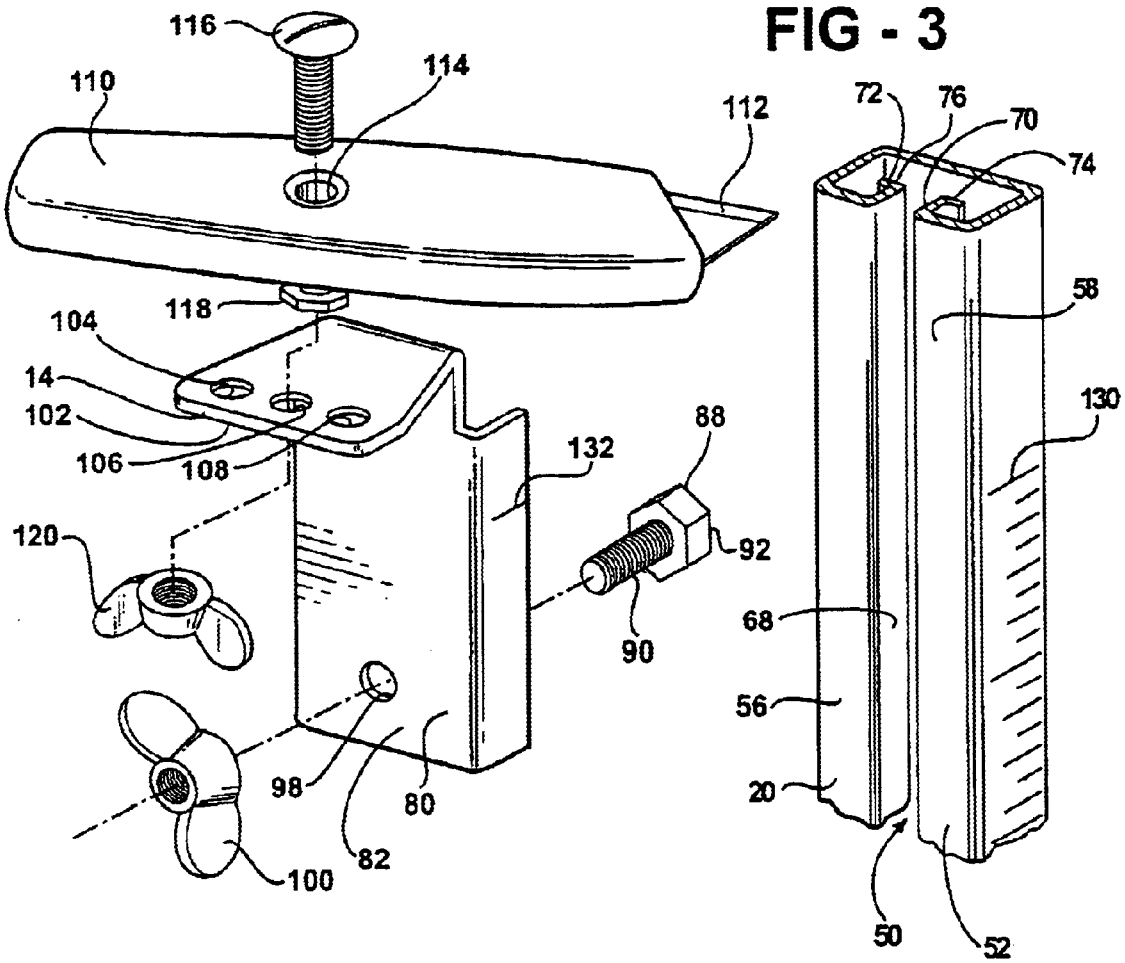
FIG. 3 is an expanded perspective view of the slider, the mat knife and the long leg.

Measurement scales 130 are engraved in side walls 60 and 62 of the long leg 20. These scales 130 can be in inches or metric units. Scale indicators 132 are engraved in both side flanges 84 and 86 of the channel-shaped base 80 as shown in FIG. 3. If desired the side walls 60 and 62 could extend inwardly and upwardly from the bottom wall 64 to make it easier to read the measurement scale 130. The shape of the slider 14 is changed to conform to the shape of the long leg 20 if the long leg 4s modified as describe above.

The short wing 34 of the head 18 has a board face contact surface 36 as explained above. This board face contact surface 36 is spaced from the board face contact surface 66, on the long leg 20, a distance that is substantially equal to the decrease in thickness of gypsum board sheets adjacent to their long edges. Gypsum board sheets 28 have a reduced thickness along their long edges to provide space for forming a joint seam having a surface in a common plane with the surface of two adjacent gypsum board sheets. The slight lifting of the head 18 of the T-square 12 when cutting a board with a uniform thickness does not change the accuracy of the board cutter. The free end of the long leg 20 still slides on the surface of the board that is being cut.

The disclosed embodiments are representative of presently preferred forms of the invention, but are intended to be illustrative rather than definitive thereof. The invention is defined in the claims.

I claim:

1. A combination T-square and cutter for making straight cuts in large boards comprising: a head having a head board edge contact surface and a head board face contact surface; a long leg connected to the head and extending to one side of the head and having a leg board face contact surface; a slider slideably mounted on the long leg and sliceable along the length of the long leg, a clamp for fixing the position of the slider in selected positions along the length of said long leg; a knife having a knife handle and a knife blade mounted in the knife handle; a pivot pin pivotally connecting the knife handle to the slider for pivotal movement about a knife axis that is parallel to a long axis of said long leg and spaced from the leg board face contact surface.

2. A combination T-square and cutter for making straight cuts in large boards comprising: a head having a head board edge contact surface and a head board face contact surface; a long leg connected to the head and extending to one side of the head and having a leg board face contact surface; a slider slideably mounted on an upper surface of the long leg and slideably along the length of the long leg, carrying a clamp for fixing the position of the slider in selected positions along the length of a said long leg and having a knife support; a knife having a knife handle and a knife blade mounted in the knife handle; a pivot pin pivotally connecting the knife handle to the knife support on the slider for pivotal movement about a knife axis that is parallel to a long axis of said long leg and spaced from the leg board face contact surface.

3. A combination T-square and cutter as set forth in claim 2 including a measurement scale on the long leg and a scale indicator on the slider.

4. A combination T-square and cutter as set forth in claim 2 including a first measurement scale on a first side wall of the long leg, a second measurement scale on a second side wall of the long leg, and a pair of scale indicators on the slider.

5. A combination T-square and cutter as set forth in claim 2 including a plurality of pivot pin mounting apertures in the knife support.

6. A combination T-square and cutter as set forth in claim 2 including a knife blade cutout in the head that partially removes the leg board face contact surface.

7. A combination T-square and cutter as set forth in claim 2 including a handle integral with the head.

8. A combination T-square and cutter as set forth in claim 7 including a handle secured to the head.

9. A method of making a cut in a large board with a T-square in combination with a cutter with a cutter handle and a cutter blade comprising: clamping a slider to a long leg of said T-square in a selected position along the length of the long leg; positioning said T-square with a board edge contact surface in contact with an edge of said large board, a board face contact surface in contact with a face surface of said large board, and a long leg board face contact surface in contact with a face surface of said large board; pivoting said cutter including the cutter handle and the cutter blade about an axis of a pivot pin pivotally connecting said cutter handle to the slider and moving said cutter blade into engagement with said large board; sliding the board edge contact surface manually along the edge of said large board and sliding a long leg board face contact surface along the face surface of said large board; and pivoting said cutter handle relative to the pivot pin and the slider to control depth of cut while simultaneously sliding said T-square.

* * * * *